United States Patent [19]

Gurevich et al.

[11] Patent Number: 4,618,279

[45] Date of Patent: Oct. 21, 1986

[54] DISHWASHING APPARATUS WITH PLURAL SPONGES

[76] Inventors: Joseph Gurevich; Alex Gurevich; Jan Gurevich, all of 64-40, 99 St., Rego Park, N.Y. 11374

[21] Appl. No.: 580,230

[22] Filed: Feb. 15, 1984

[51] Int. Cl.[4] ..... A47L 17/00; A47L 13/19; A46B 11/06

[52] U.S. Cl. ..... 401/36; 401/17; 401/23; 401/41; 401/42; 401/44; 401/45; 401/46; 401/47; 401/203; 401/289; 211/41

[58] Field of Search ..... 401/203, 289, 41, 42, 401/43, 24, 23, 36, 39, 44–47, 17; 211/41

[56] References Cited

U.S. PATENT DOCUMENTS

| | | | |
|---|---|---|---|
| 222,031 | 11/1879 | Gerike | 401/24 |
| 680,427 | 8/1901 | Carryl | 401/36 |
| 786,985 | 4/1905 | Nicholls | 401/47 |
| 1,217,597 | 2/1917 | Hecht et al. | 401/42 |
| 2,508,841 | 5/1950 | Schreibman | 211/41 |
| 2,508,958 | 5/1950 | Manville | 401/46 |
| 2,528,388 | 10/1950 | Richards | 211/41 |
| 2,634,936 | 4/1953 | Meline | 211/41 |
| 2,689,767 | 9/1954 | Dabringhaus, Jr. | 401/46 X |
| 2,779,962 | 2/1957 | Cooper | 401/42 |
| 2,797,132 | 6/1957 | Alpert | 401/46 X |
| 2,876,040 | 3/1959 | De Simone et al. | 401/43 X |
| 3,258,809 | 7/1966 | Harvey | 401/42 X |

FOREIGN PATENT DOCUMENTS

| | | | |
|---|---|---|---|
| 534286 | 1/1955 | Belgium | 401/43 |

*Primary Examiner*—Steven A. Bratlie
*Attorney, Agent, or Firm*—Ilya Zborovsky

[57] ABSTRACT

A dishwashing apparatus has a grip with a water supply receptacle and a liquid detergent receptacle, and a working head with a plurality of portions circumferentially arranged about its axis and with a water outlet formed in one portion and a liquid detergent outlet formed in another portion.

4 Claims, 7 Drawing Figures

DISHWASHING APPARATUS WITH PLURAL SPONGES

BACKGROUND OF THE INVENTION

This invention relates generally to the manualy operated dishwashing apparatus as an attachment to the faucet.

The use of electric dishwashing mashines is widespread in the United States, however, the machines become useless when the number of items to be washed is limited. Furthermore, the cost and the space needed to install such machines make it unavailable to the average household.

The proposed invention successfully solves this and other problems, since it provides a low cost manualy operated apparatus.

SUMMARY OF THE INVENTION

It is an object of the present invention to provide a simple and easy to use and low cost device to improve the dishwashing process and to eliminate the use of hands in process so as preserve the user's hands skin condition.

It is another object of our invention is to save amount of water and electricity as compared with the operation of conventional dishwasher and to improve the quility and to reduce the amount of uncleaned burn ons and spots.

Further objects or advantages of the invention will become apparent from consideration of drawings and ensuing description thereof.

BRIEF DESCRIPTION OF DRAWINGS

FIG. I. is a vertical cross section of the inventive apparatus.

DESCRIPTION OF PREFERRED EMBODIMENTS

Figure 1:
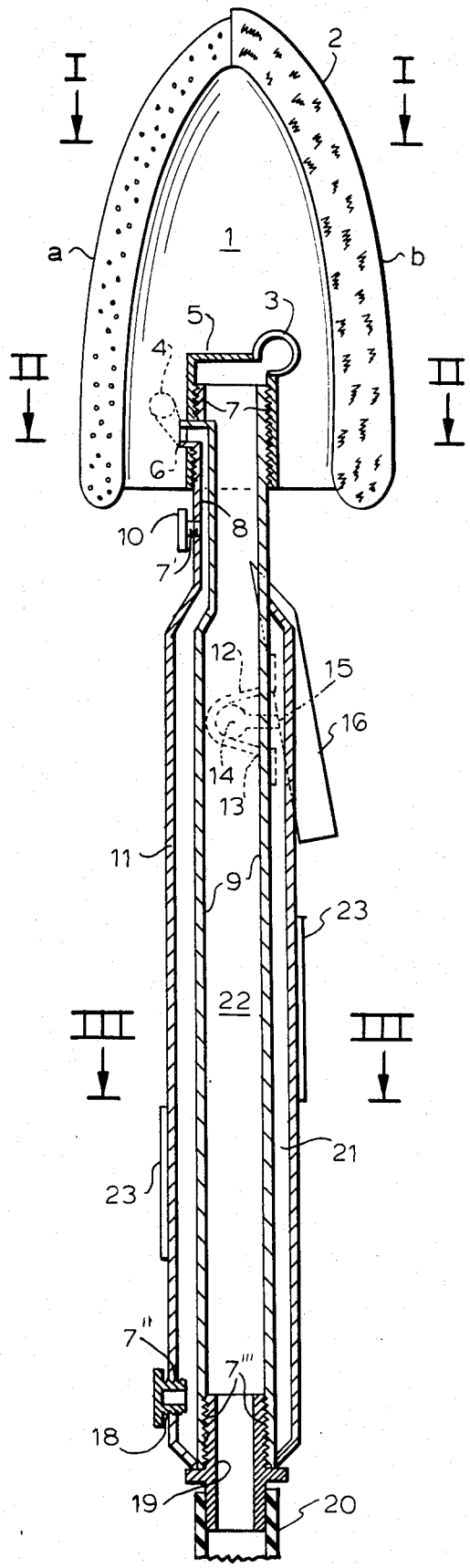
Figure 2:
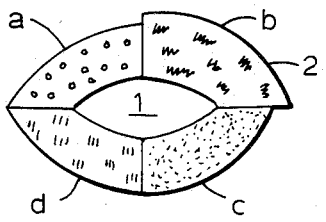
FIG. 2. is a horizontal cross section of the upper part of the working head of the apparatus.
Figure 5:
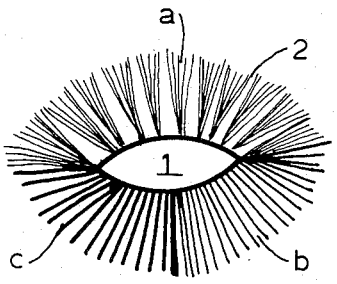
FIG. 5. is a horizontal cross cut of the upper part of the working head in accordance with another embodiment of the invention.
Figure 3:
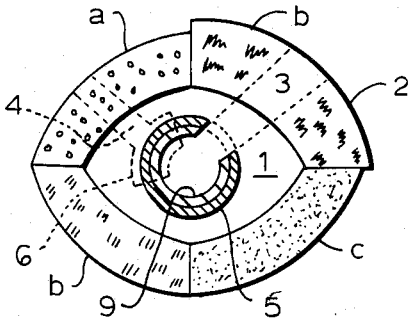
FIG. 3. is a horizontal cross section of the lower part of the working head.
Figure 6:
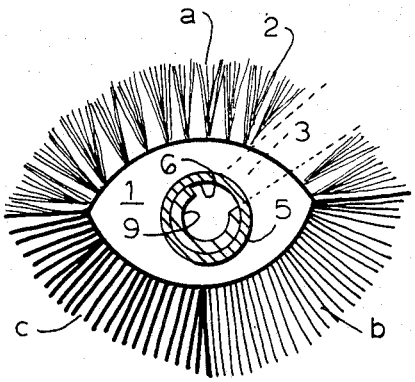
FIG. 6. is a horizontal cross cut of the lower part of the the working head of the other embodiment.
Figure 4:
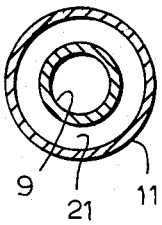
FIG. 4. is a horizontal cross cut of the handle.

A manually operated dishwashing apparatus in accordance with the present invention includes a working head which is identified with reference numeral (1) and formed as a tongue. In the embodiment shown in FIG. 1 the tongue-shaped working head (1) is formed as a sponge, whereas in the embodiment of FIG. 5 it is formed as a brush. The working head has a supporting member (5) formed as a metal temple. An opening (3) provides supply of water to the working head, whereas an opening (4) provides supply of liquid detergent to the same. However, the openings 3 and 4 are offset peripherally relative to one another as can be seen from FIG. 3.

A grip of the inventive apparatus includes a waterproof grip cover (23), a wall located inside the cover and identified with reference numeral (11), and a water supplying pipe located inside the wall (11) and identified with reference numeral (9). The pipe (9) forms a water supplying passage (22). A liquid detergent storage space is formed between the pipe (9) and the wall (11), as identified with reference numeral (21). The storage space (21) extends into a narrow channel identified with (8) in FIG. 1 and ends in a widened portion (6) which is alignable with the opening (4). A thread (7) connects the grip with the temple (5). A knob which regulates the supply of liquid detergent and controls air exit for refilling the liquid detergent storage space is identified with (10) and inserted into a threaded hole (7') in the wall (11). A lid (17) for the liquid detergent storage chamber is inserted into a hole (18) which controls air supply as the level of liquid detergent diminishes in the channel (8). The hole (18) has a thread 7''. A pipe connector 19 connects by a thread 7''' a rubber hose 20 with the grip.

Figure 7:
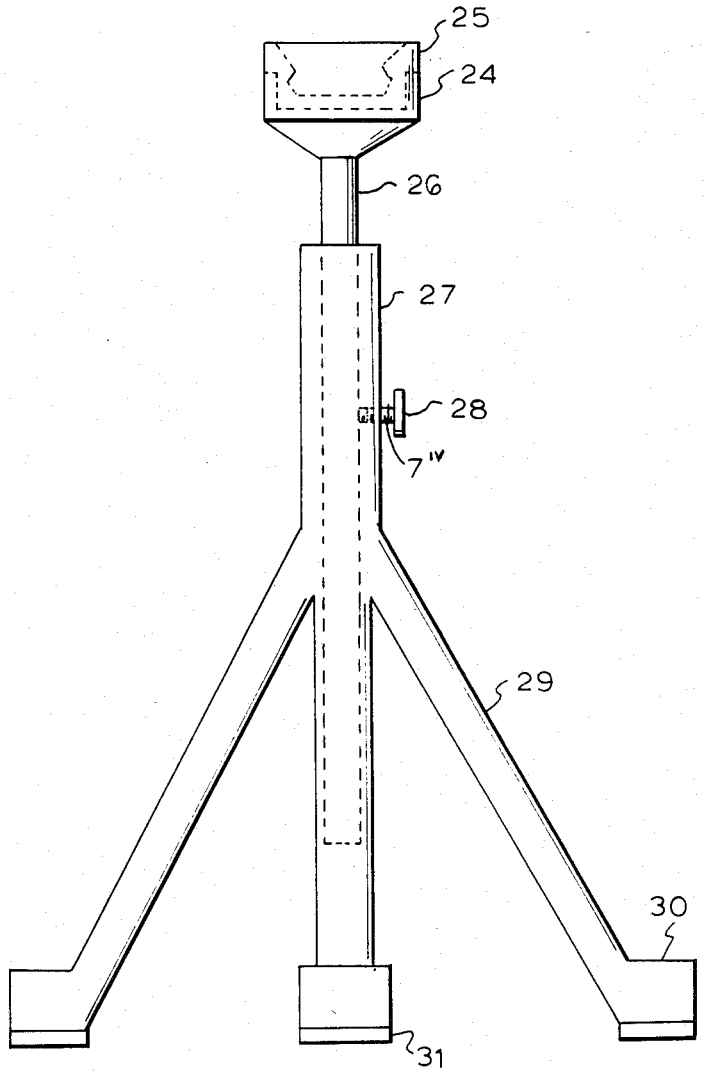
FIG. 7. is a dish holder.

FIG. 7 shows a dish holder with a top 24, a rubber mounting 25, and a stand 27 in which a neck 26 of the top 24 is inserted. A bolt 28 extending through a threaded hole 7' adjust the height of the top 24. Legs, feet and rubber soles of the stand are identified with reference numerals 29, 30 and 31 respectively.

Coming back to the grip-working head part of the apparatus, it can be seen that reference numeral (12) identifies a rubber hose, (13) identifies an opening for arranging a water supply controlling valve, (14) identifies the above mentioned valve, (15) identifies a connector between the valve and a flow control knob, and (16) identifies the knob.

OPERATION

In order to refill the apparatus with a liquid detergent, the apparatus must be placed on its side with the knobs (IO) and (I7) open and facing up. Thereafter, the liquid is directed into the opening (I7) down to the chamber (2I). After the refilling is completed the knobs (IO) and lid (I7) are closed and the apparatus is ready for use.

For additional convinience dish holder, shown in FIG. 7 is used. The holder can be mounted in the sink permanently or removable if so desired by user. As shown in FIG. 7 the dish can be leaned against the top (24). The apparatus can be used for the dishes of different sizes and therefore the "neck" (26) may be adjusted by the multi level bolt (20).

The sponge like material which covers the "tongue" of said apparatus is composed of four different sections:

(a) Soft section used for washing surfaces where no scrubing required. This section has an opening from which the liquid detergent discharges.

(b) Section II used for rinsing.

(c) Section III equiped with semi-rough sponge used for the surfaces not cleaned with section 1.

(d) Section IV equipped with a rough sponge and designed primarily for cleaning burns on pots and pans.

As was previously mentioned in the soft section (I) the opening (3) is provided. It supplies water and is regulated by knob (I6). Furthermore, another opening in the section in question is provided to supply liquid detergent (4), and regulated by knob (IO).

The air-outlet (I8) is also arranged to compensate the balance of air and liquid in the chamber (2I), and as the amount of said liquid diminishes the air takes the said place.

It is in the contemplation of this invention that the washing process is to be started, first with a "soft section" part (I) of the "tongue" with said opening (4), by pressing the knob (I6), by thumb and cutting off the thereby water supply. Further, the apparatus should be rotated to the left until the surface of the section II with the water outlet (3) is in operation this step will remove the grease and soap from the item in question. If further rinsing is desired, this may be achieved by holding the apparatus few inches away from the item and directing the water spurt to the item. In the case of pots and pans, where the burn ons are frequent the sections (III) (medium) or (IV) (rough) are used at the discretion of the user. Once the scrabing process is completed the use of soft section (1) with soap is recomended. Thereafter, rinsing with section (11) completes the process.

It is also contemplated in this invention to provide an option of washing items with a grain brush. With the use of the brush the use of the liquid detergent is no longer essential, therefore, the regulator (IO) should be shut off. The use of this feature is advantageous, since the roughness of the grain brush permits the scrubbing process to achieve the expected results without the use of soaps—simply by adjusting the pressure applied to the brush.

Both sponge and the brush heads are designed for use interchangeably and expected to be sold as one package with the apparatus.

The brush head is designed to include three sections:

($a_i$) Medium roughness of nylon hair.

($b_i$) Rough grain made of thicker hairs planted closer to each other.

($c_i$) Rough grain made of copper (or similar metal) designed to use on pots and pans.

The section $a_i$ of medium roughness is equiped with water supply opening (3) as specified previously, with flow control knob (I6). It is believed that the best way to use the apparatus is to employ section (a) for scrubbing and then rinsing. And in the adverse case, the use of the section (c) is recomended for the best results. Thereafter, the rinsing process is repeated.

A holder is further provided to store the apparatus when not in use. The holder represents a ring manufactured of plastic or light metal.

While the above description contains many specifities, these should not be construed as limitations on the scope of the invention, but rather as an exemplification of one prefered embodiment thereof. Many other variations are possible. Accordingly, the scope of the invention should be determined not by the embodiment illustrated, but the appended claims and their legal equivalents.

We claim:

1. A dishwashing apparatus, comprising a hand grip provided with water supply means and liquid detergent supply means and having an upper end, said liquid detergent supply means having a storage facility formed in said grip;

a tongue-like hollow working head mountable on said upper end of said grip so that said upper end of said grip extends into the interior of said hollow working head, said working head having an axis, said working head including a plurality of portions integrally arranged circumferentially around said axis and formed as contiguous sponges having different degrees of softness so as to apply to dishes different actions, said working head having a water outlet provided in one of said portions and communicating with said water supply means so that said water supply means supply water to be discharged through said water outlet, and said working head also having a liquid detergent outlet provided in another of said portions and communicating with said liquid detergent supply means so that said liquid detergent supply means supply detergent to be discharged through said liquid detergent outlet, whereby during rotation of said working head about said axis the discharged liquid detergent and said another portion act on a dish and then the discharged water and said one portion act on the same dish successively;

passage means including a passage communicating said liquid detergent supply means with said liquid detergent outlet and also a passage communicating said water supply means with said water outlet;

manually actuatable valve means cooperating with said passages so as to allow the liquid detergent and the water to flow selectively through the respective passages successively and to said liquid detergent outlet and water outlet successively so as to first wash and then rinse the dish; and an adapter arranged to connect said grip with a faucet of water system.

2. A dishwashing apparatus as defined in claim 1; and further comprising manual means for adjusting the quantity of water supply by said water supply means.

3. A dishwashing apparatus as defined in claim 1, and further comprising manual means for adjusting the quantity of liquid detergent supply by said liquid detergent supply means.

4. A dishwashing apparatus as defined in claim 1, wherein said working head is connected with said grip removable; and further comprising means for removably connecting said working head with said grip.

* * * * *